US009371700B2

(12) United States Patent
DiGiovanni

(10) Patent No.: US 9,371,700 B2
(45) Date of Patent: Jun. 21, 2016

(54) SUPERABRASIVE CUTTING ELEMENTS WITH CUTTING EDGE GEOMETRY HAVING ENHANCED DURABILITY AND CUTTING EFFICIENCY AND DRILL BITS SO EQUIPPED

(75) Inventor: Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 545 days.

(21) Appl. No.: 13/116,936

(22) Filed: May 26, 2011

(65) Prior Publication Data

US 2011/0303466 A1 Dec. 15, 2011

Related U.S. Application Data

(60) Provisional application No. 61/353,507, filed on Jun. 10, 2010.

(51) Int. Cl.
*E21B 10/36* (2006.01)
*E21B 10/567* (2006.01)

(52) U.S. Cl.
CPC ..... *E21B 10/5673* (2013.01); *E21B 10/5676* (2013.01)

(58) Field of Classification Search
CPC ..... E21B 10/5673; E21B 10/567; E21B 10/5676; E21B 10/573
USPC ..... 175/432, 428, 374, 426, 431, 434
See application file for complete search history.

(56) References Cited

U.S. PATENT DOCUMENTS

| | | | | |
|---|---|---|---|---|
| 4,109,737 | A | 8/1978 | Bovenkerk | |
| RE32,036 | E | 11/1985 | Dennis | |
| 4,858,707 | A | 8/1989 | Jones et al. | |
| 4,987,800 | A | 1/1991 | Gasan et al. | |
| 5,016,718 | A | 5/1991 | Tandberg | |
| 5,437,343 | A | 8/1995 | Cooley et al. | |
| 5,881,830 | A | 3/1999 | Cooley | |
| 6,006,846 | A | 12/1999 | Tibbitts et al. | |
| 6,330,924 | B1 * | 12/2001 | Hall | 175/430 |

(Continued)

FOREIGN PATENT DOCUMENTS

| | | |
|---|---|---|
| EP | 0656458 A2 | 6/1995 |
| EP | 1886749 A1 | 2/2008 |

(Continued)

OTHER PUBLICATIONS

Grandia et al., "Diamond Tool Tip for Ultra Sonic Drilling"; IBM Technical Disclosure Bulletin vol. 13, No. 11, Apr. 1971, p. 3285.

(Continued)

*Primary Examiner* — Nicole Coy
(74) *Attorney, Agent, or Firm* — TraskBritt

(57) ABSTRACT

A superabrasive cutting element including a diamond or other superabrasive material table having a peripheral cutting edge defined by at least one chamfer between a cutting face and a side surface of the table, an arcuate surface extending between the cutting face and an innermost chamfer of the at least one chamfer and a sharp, angular transition between an outermost chamfer of the at least one chamfer and the side surface. Methods of producing such superabrasive cutting elements and drill bits equipped with such superabrasive cutting elements are also disclosed.

20 Claims, 2 Drawing Sheets

(56) References Cited

U.S. PATENT DOCUMENTS

| | | | | |
|---|---|---|---|---|
| 6,527,069 | B1 | 3/2003 | Meiners et al. | |
| 6,935,444 | B2 | 8/2005 | Lund et al. | |
| 7,188,692 | B2 | 3/2007 | Lund et al. | |
| 7,475,744 | B2 * | 1/2009 | Pope | 175/430 |
| 7,681,669 | B2 | 3/2010 | Cannon et al. | |
| 2006/0016626 | A1 | 1/2006 | Lund et al. | |
| 2006/0157285 | A1 | 7/2006 | Cannon et al. | |
| 2006/0157286 | A1 | 7/2006 | Pope | |
| 2008/0164071 | A1 * | 7/2008 | Patel et al. | 175/431 |
| 2008/0292415 | A1 | 11/2008 | Kuroda et al. | |
| 2009/0057031 | A1 * | 3/2009 | Patel et al. | 175/420.2 |
| 2009/0152018 | A1 | 6/2009 | Sani | |
| 2010/0326742 | A1 * | 12/2010 | Vempati et al. | 175/431 |

FOREIGN PATENT DOCUMENTS

| | | | |
|---|---|---|---|
| GB | 2193749 | A | 2/1988 |
| JP | 2004291204 | A | 10/2004 |
| WO | 2007044791 | A1 | 4/2007 |
| WO | 2008076420 | A1 | 6/2008 |

OTHER PUBLICATIONS

International Search Report for International Application No. PCT/US2011/038204 dated Feb. 9, 2012, 3 pages.

International Written Opinion for International Application No. PCT/US2011/038204 dated Feb. 9, 2012, 4 pages.

* cited by examiner

SUPERABRASIVE CUTTING ELEMENTS WITH CUTTING EDGE GEOMETRY HAVING ENHANCED DURABILITY AND CUTTING EFFICIENCY AND DRILL BITS SO EQUIPPED

CROSS-REFERENCE TO RELATED APPLICATION

This application claims the benefit of U.S. Provisional Patent Application Ser. No. 61/353,507, filed Jun. 10, 2010, the disclosure of which is hereby incorporated herein in its entirety by this reference.

FIELD

Embodiments of the present disclosure relate generally to cutting elements of the type employing a table of superabrasive material having a peripheral cutting edge and used for drill bits for subterranean drilling, and specifically to modifications to the geometry of the peripheral cutting edge for enhanced durability without loss of cutting efficiency.

BACKGROUND

Superabrasive cutting elements in the form of Polycrystalline Diamond Compact (PDC) structures have been commercially available for approximately three decades, and substrate-mounted PDC cutting elements having substantially planar cutting faces have been used commercially for a period in excess of twenty years. The latter type of PDC cutting elements commonly comprises a thin, substantially circular disc (although other configurations are available), commonly termed a "table," including a layer of superabrasive material formed of diamond crystals mutually bonded under ultrahigh temperatures and pressures and defining a substantially planar front cutting face, a rear face and a peripheral or circumferential edge, at least a portion of which is employed as a cutting edge to cut the subterranean formation being drilled by a drill bit on which the PDC cutting element is mounted. PDC cutting elements are generally bonded over their rear face during formation of the superabrasive table to a backing layer or substrate formed of cemented tungsten carbide, although self-supporting PDC cutting elements are also known, particularly those stable at higher temperatures, which are known as Thermally Stable Products, or "TSPs."

Either type of PDC cutting element is generally fixedly mounted to a rotary drill bit, generally referred to as a drag bit, which cuts the formation substantially in a shearing action through rotation of the bit and application of drill string weight or other axial force, such weight or force being termed "weight on bit" (WOB) thereto. A plurality of either, or even both, types of PDC cutting elements is mounted on a given bit, and cutting elements of various sizes may be employed on the same bit.

Drag bit bodies may be cast and/or machined from metal, typically steel, may be formed of a powder metal infiltrated with a liquid binder at high temperatures to form a matrix-type bit body, or may comprise a sintered metal mass. PDC cutting elements may be brazed to a matrix-type bit body after furnacing, or TSPs may even be bonded into the bit body during the furnacing process used for infiltration of matrix-type bits. Cutting elements are typically secured to cast or machined (steel body) bits by preliminary bonding to a carrier element, commonly referred to as a stud, which in turn is inserted into an aperture in the face of the bit body and mechanically or metallurgically secured thereto. Studs are also employed with matrix-type bits, as are cutting elements secured via their substrates to cylindrical carrier elements affixed, in turn, to the matrix-type bit body.

It has long been recognized that PDC cutting elements, regardless of their method of attachment to drag bits, experience relatively rapid degradation in use due to the extreme temperatures and high loads, particularly impact loading, as the drag bit drills ahead downhole. One of the major observable manifestations of such degradation is the fracture or spalling of the PDC cutting element cutting edge, wherein large portions of the superabrasive PDC layer separate from the cutting element. The spalling may spread down the cutting face of the PDC cutting element, and even result in delamination of the superabrasive layer from the backing layer of substrate, or from the bit itself if no substrate is employed. At the least, cutting efficiency is reduced by cutting edge damage, which also reduces the rate of penetration (ROP) of the drag bit into the formation. Even minimal fracture damage can have a negative effect on cutter life and performance. Once the sharp corner on the leading edge (taken in the direction of cutter movement) of the diamond table is chipped, the amount of damage to the table continually increases, as does the axial, also termed normal, force (WOB) required to achieve a given depth of cut. Therefore, as damage to the cutting edge and cutting face occurs and the rate of penetration of the drag bit decreases, the conventional rig-floor response of increasing weight on bit quickly leads to further degradation and ultimately catastrophic failure of the chipped cutting element.

It has been recognized in the machine-tool art that chamfering of a diamond tool tip for ultrasonic drilling or milling reduces splitting and chipping of the tool tip. J. Grandia and J. C. Marinace, "DIAMOND TOOL-TIP FOR ULTRA-SONIC DRILLING"; IBM Technical Disclosure Bulletin Vol 13, No. 11, April 1971, p. 3285. Use of beveling or chamfering of diamond and cubic boron nitride compacts to alleviate the tendency toward cutter edge chipping in mining applications was also recognized in U.K. Patent Application GB 2193749 A.

U.S. Pat. No. 4,109,737 to Bovenkerk discloses, in pertinent part, the use of pin- or stud-shaped cutting elements on drag bits, the pins including a layer of polycrystalline diamond on their free ends, the outer surface of the diamond being configured as cylinders, hemispheres or hemisphere approximations formed of frustoconical flats.

U.S. Pat. No. Re 32,036 to Dennis discloses the use of a beveled cutting edge on a disc-shaped, stud-mounted PDC cutting element used on a rotary drag bit.

U.S. Pat. No. 4,987,800 to Gasan, et al. references the aforementioned Dennis reissue patent and offers several alternative edge treatments of PDC cutting elements, including grooves, slots and pluralities of adjacent apertures, all of which purportedly inhibit spalling of the superabrasive PDC layer beyond the boundary defined by the groove, slot or row of apertures adjacent the cutting edge.

U.S. Pat. No. 5,016,718 to Tandberg discloses the use of planar PDC cutting elements employing an axially and radially outer edge having a "visible" radius, such a feature purportedly improving the "mechanical strength" of the element.

U.S. Pat. No. 5,437,343 to Cooley et al., assigned to the assignee of the present invention and the disclosure of which is incorporated herein in its entirety by reference, discloses cutting elements with diamond tables having a peripheral cutting edge defined by a multiple chamfer. Two adjacent chamfers (Cooley et al., FIG. 3) or three adjacent chamfers (Cooley et al., FIG. 5) are disclosed. The use of both two and three mutually adjacent chamfers was found to produce robust cutting edges which still afforded good drilling efficiency. It was found that a three chamfer geometry, which more closely approximates a radius at the cutting edge than does a two chamfer geometry, may be desirable from a durability standpoint. Unfortunately, it was also determined that grinding three chamfers takes additional time and requires precise alignment of the cutting edge and grinding tool to provide a consistent cross-sectional configuration along the cutting edge.

U.S. Pat. No. 6,935,444 to Lund et al., assigned to the assignee of the present invention and the disclosure of which is incorporated herein in its entirety by reference, discloses cutting elements with diamond tables having a peripheral cutting edge defined by multiple surfaces extending linearly when viewed from the side of the cutting element, and at least two adjacent surfaces having an arcuate boundary therebetween. This edge geometry, as was the case with those of the '343 patent, also takes significant time to produce, requires precise alignment of the cutting edge with a grinding tool, and in practice does not provide a desirably aggressive cutting edge.

In summary, it has been demonstrated that if the initial chipping of the diamond table cutting edge can be eliminated, the life of a cutter can be significantly increased. Modification of the cutting edge geometry was perceived to be a promising approach to reduce chipping, but has yet to realize its full potential in terms of combining durability with aggressive cutting characteristics in conventional configurations.

BRIEF SUMMARY

An embodiment of the present disclosure provides an improved cutting edge geometry for superabrasive cutting elements comprising at least one chamfer between a cutting face and a side surface of a superabrasive table, with an arcuate surface interposed between an inner boundary of an innermost chamfer of the at least one chamfer and the cutting face, and a sharp, angular transition between an outer boundary of an outermost chamfer of the at least one chamfer and the side surface.

While the present disclosure is disclosed herein in terms of embodiments employing PDC cutting elements, it is equally applicable to other superabrasive materials such as TSPs, cubic boron nitride, diamond films and silicon nitride, as well as diamond-like carbon films.

In one embodiment of the disclosure, a cutting element includes a superabrasive table having a peripheral cutting edge defined by a cutting face and an adjacent single chamfer having an arcuate surface interposed therebetween, a boundary between the single chamfer and a side surface of the superabrasive table comprising a sharp, angular transition. The cutting face and adjacent single chamfer may each contact the arcuate surface in a substantially tangential relationship therewith.

In the aforementioned embodiment, the chamfer and the arcuate surface may be of at least substantially annular configuration, comprising a complete or partial annulus extending peripherally along the cutting edge.

In another embodiment, the cutting element may comprise multiple chamfers between the side surface of the superabrasive table and the arcuate surface between an innermost chamfer and the cutting face.

Embodiments of the present disclosure also encompass drill bits carrying one or more cutting elements according to the present disclosure.

DETAILED DESCRIPTION

Figure 1:
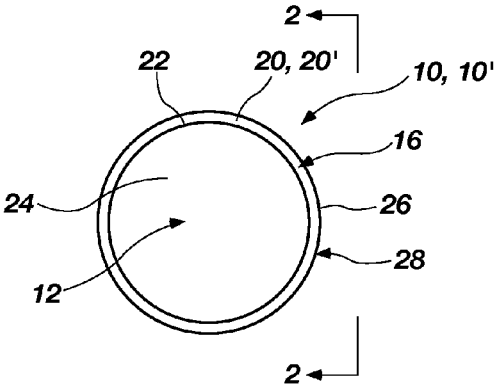
FIG. 1 is a front elevation of a round PDC cutting element according to embodiments of the present disclosure.

It has been established that chamfering or beveling of the cutting edge or cutting face periphery of a planar PDC cutting element does, in fact, reduce, if not prevent, edge chipping and failure due to fracturing. It has been discovered that radiused cutter edges also greatly enhance chip resistance of the cutting edge. However, testing has confirmed that the degree of benefit derived from chamfering or radiusing the edge of the diamond table of a cutting element is extremely dependent on the dimension of the chamfer or the radius. In measuring a chamfer, the dimension is taken perpendicularly, or depth-wise, from the front of the cutting face to the point where the chamfer ends. For a radiused edge, the reference dimension is the radius of curvature of the rounded edge. To provide the maximum beneficial anti-chipping effect, it has been established that the chamfer or the radius on the edge of the diamond table must be relatively large, on the order of 0.040-0.045 inches. However such large chamfers significantly reduce cutting efficiency. Smaller chamfers and edge radii, on the order of 0.015-0.020 inches, are somewhat less effective in providing fracture resistance in comparison to the larger dimension chamfers and radii but do provide better cutting efficiency. Sharp-edged cutters provide maximum cutting efficiency but are extremely fragile and can be used in only the least challenging drilling applications. This deficiency of smaller chamfered and radiused edge cutting elements is particularly noticeable under repeated impacts such as those to which cutting elements are subjected in real world drilling operations.

The fact that chamfers and radii are dimension-dependent in their anti-chipping and cutting effectiveness has dictated a delicate choice in chamfer design to find the optimum for each application. Since a single bit run typically spans a variety of formations, the requirement for durability often leads to practical compromises resulting in extremely sub-optimal cutting efficiency through much of the run. A more robust edge finishing technology was needed to provide improved cutting efficiency without giving away cutter durability in the form of chipping and fracture. While the aforementioned triple chamfer provides some of this effect, and a double chamfer with an arcuate surface interposed between the two chamfers also seemed promising, the inventor herein has discovered that a chamfer with a sufficiently large radius or otherwise arcuate surface at an inner boundary with the cutting face and a sharp transition at an outer boundary with a side surface provides significant benefits over the foregoing cutting edge geometries.

Referring to FIGS. 1 through 3 and 5 of the drawings, the PDC cutting element 10 in accordance with the present disclosure includes a substantially planar diamond or other superabrasive table 12, which may or may not be laminated to a tungsten carbide substrate 14 of the type previously described. As used herein, the term "substantially planar"

means and includes a table having a cutting face extending in two directions, the table having a width substantially greater than a depth. The cutting face need not be planar, nor an interface between the table 12 and a substrate 14, such an interface usually being, according to the present state of the art, non-planar. The diamond table 12 may be of circular configuration as shown, may be of half-round or tombstone shape, comprise a larger, non-symmetrical diamond table formed from smaller components or via diamond film techniques, or comprise other configurations known in the art or otherwise. Outer periphery 16 of diamond table 12 ("outer" indicating the edge of the cutting element which engages the formation 38 (FIG. 5) as the bit rotates under WOB in a drilling operation) is of a combination arcuate surface/chamfer configuration, including chamfer surface 20 and adjacent arcuate surface 22 at an inner boundary of chamfer surface 20 with cutting face 24 of diamond table 12, and a sharp, angular transition 26 at an outer boundary of chamfer surface 20 with side surface 28 of diamond table 12. If a substrate 14 is used, side surface 28 of diamond table 12 is usually contiguous with the side 18 of substrate 14, which in turn is usually perpendicular to the plane of the diamond table 12. In some embodiments, the side surface 18 of substrate may, in the vicinity of its interface with diamond table 12, lie at an acute angle to the longitudinal axis L of the PDC cutting element 10, with the side surface 28 of diamond table 12 being contiguous therewith and at the same angle.

Figure 2:
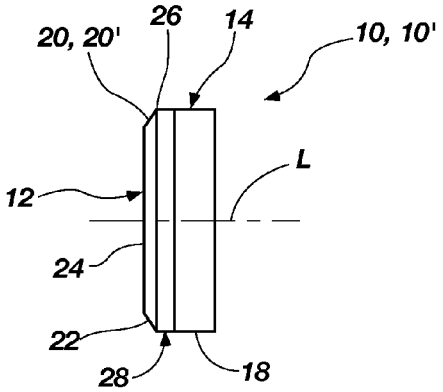
FIG. 2 is a side elevation of the cutting element of FIG. 1, taken across line 2-2.
Figure 3:
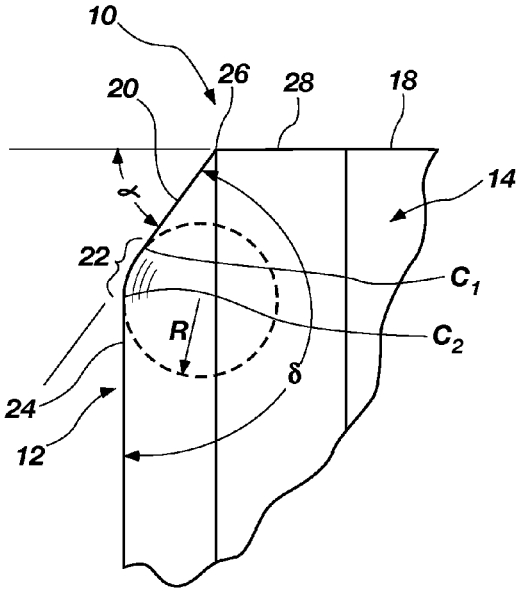
FIG. 3 is an enlarged side elevation of an outer periphery of the cutting element as generally depicted in FIG. 1 from the same perspective as that of FIG. 2.

In the embodiment of FIGS. 1 through 3, the chamfer surface 20 departs at an acute angle from the orientation of the diamond table side surface 28, which (in a conventional PDC cutting element) is usually perpendicular or at 90° to the plane of diamond table 12. Chamfer surface 20 may be disposed at an angle $\alpha$ of between about 15° and about 70° to the side surface 28 of diamond table 12 which, as shown in FIGS. 1 and 2, is parallel to longitudinal axis L of cutting element. However, the disclosure is not so limited to the foregoing angles, and it should be noted that the use of diamond table faces and sides which are not mutually perpendicular (such as, for example, in the case of cutting elements having a concave or other protruding face configuration or a side which is oriented at an angle to longitudinal axis L) may, of necessity, change the respective magnitude of angle $\alpha$.

Another manner of characterizing the present disclosure may be in terms of the included angle between chamfer surface 20 and cutting face 24 wherein, in accordance with the present disclosure, an included angle $\delta$ between chamfer surface 20 and cutting face 24 is greater than about 135°.

Arcuate surface 22, which may (as shown in FIG. 3), but need not necessarily, comprise a radius of curvature, desirably extends to respective contact points $C_1$ and $C_2$ with chamfer surface 20 and cutting face 24. While an exact tangential relationship may not be required, it is desirable that chamfer surface 20 and cutting face 24 respectively lie as tangentially as possible to the curve of arcuate surface 22 at respective contact points $C_1$ and $C_2$. It is further desirable that at least one of the chamfer surface 20 and cutting face 24 contact arcuate surface 22 tangentially. Thus, as particularly well depicted in cross-section in FIG. 3, chamfer surface 20 and cutting face 24 are substantially linear, while interposed surface 22 is arcuate and (by way of example) comprises a radius of curvature R (FIG. 3) to which chamfer surface 20 and cutting face 24 are substantially tangent at respective contact points $C_1$ and $C_2$. It should be noted that arcuate surface 22 is shown as shaded in FIG. 3 and with indistinct respective boundaries with chamfer surface 20 and cutting face 24 as, in practice, a precisely tangential contact between arcuate surface 22 and each of the flanking surfaces 20 and 24 will not exhibit any distinct boundary and a substantially tangential contact will in many instances result in an equally indistinct boundary.

It is believed that stress risers at the sharp-angled periphery of a conventional cutting element diamond table are at least to some degree responsible for chipping and spalling. While radiusing of the diamond table edge eliminates the angled edge, as noted previously the large radius required for effective chip, spalling and fracture resistance is achieved at an unacceptable cost and reduces the aggressivity of the cutting edge to an unacceptable degree. The arcuate surface interposed between the cutting face and chamfer depicted in FIGS. 1-3 is believed to exhibit the same resistance to impact-induced destruction as the large radius approach, apparently reducing the diamond table edge stress concentration below some threshold level, while the sharp, angular transition between the chamfer and side surface of the diamond table provides an efficient cutting action.

Figure 4:
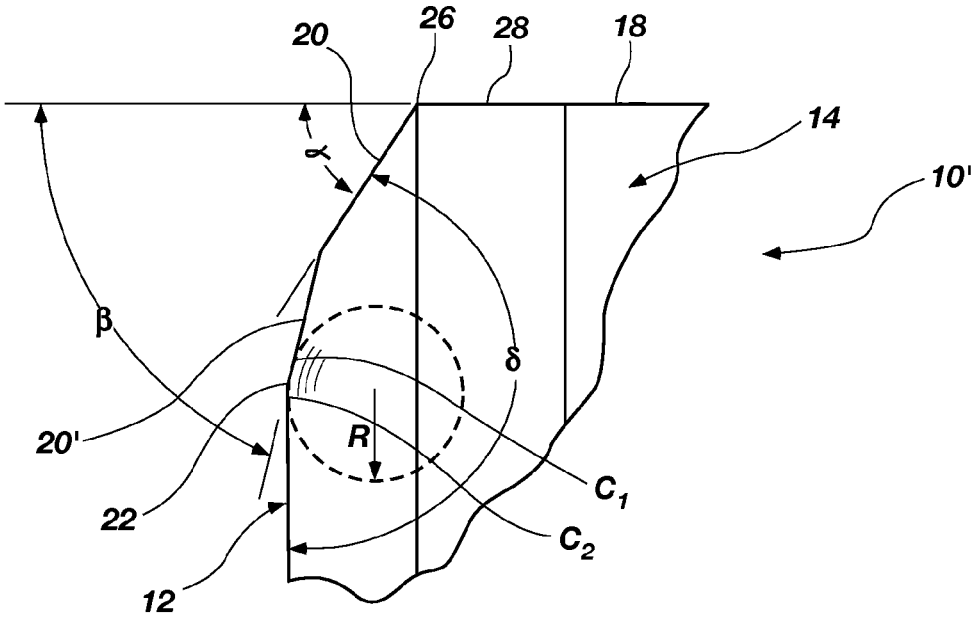
FIG. 4 is an enlarged side elevation of an outer periphery of a cutting element according to another embodiment of the disclosure as generally depicted in FIG. 1 and from the same perspective as that of FIG. 2.

FIG. 4 depicts another embodiment of a PDC cutting element 10' of the present disclosure, wherein elements described previously with respect to FIGS. 1 through 3 are indicated by like reference numerals. Referring to FIGS. 1, 2, 4, and 5, PDC cutting element 10' includes a substantially planar diamond or other superabrasive table 12, which may or may not be laminated to a tungsten carbide substrate 14 of the type previously described. The cutting face need not be planar, nor an interface between the table 12 and a substrate 14, such an interface usually being, according to the present state of the art, non-planar. The diamond table 12 may be of circular configuration as shown, may be of half-round or tombstone shape, comprise a larger, non-symmetrical diamond table formed from smaller components or via diamond film techniques, or comprise other configurations known in the art or otherwise. Outer periphery 16 of diamond table 12 ("outer" indicating the edge of the cutting element which engages the formation 38 (FIG. 5) as the bit rotates under WOB in a drilling operation) is of a combination arcuate surface/chamfer configuration, including radially outer chamfer surface 20, radially inner chamfer surface 20', and adjacent arcuate surface 22 at an inner boundary of radially inner chamfer surface 20' with cutting face 24 of diamond table 12, and a sharp, angular transition 26 at an outer boundary of radially outer chamfer surface 20 with side surface 28 of diamond table 12. If a substrate 14 is used, side surface 28 of diamond table 12 is usually contiguous with the side 18 of substrate 14, which in turn is usually perpendicular to the plane of the diamond table 12. In some embodiments, the side surface 18 of substrate may, in the vicinity of its interface with diamond table 12, lie at an acute angle to the longitudinal axis L of the PDC cutting element 10, with the side surface 28 of diamond table 12 being contiguous therewith and at the same angle.

In the embodiment of FIGS. 1, 2 and 4, the chamfer surface 20 departs at an acute angle from the orientation of the diamond table side surface 28, which (in a conventional PDC cutting element) is usually perpendicular or at 90° to the plane of diamond table 12. Chamfer surface 20 may be disposed at an angle $\alpha$ of between about 15° and about 70° to the side surface 28 of diamond table 12 which, as shown in FIGS. 1 and 2, is parallel to longitudinal axis L of cutting element. Radially inner chamfer surface 20' may be disposed at an angle $\beta$ to the side surface 28 of diamond table 12, angle $\beta$ relative to side surface 28 being greater than angle $\alpha$ ($\beta>\alpha$). However, the disclosure is not so limited to the foregoing angles, and it should be noted that the use of diamond table faces and sides which are not mutually perpendicular (such as, for example, in the case of cutting elements having a concave or other protruding face configuration or a side which is oriented at an angle to longitudinal axis L) may, of necessity, change the respective magnitude of angle α.

Another manner of characterizing the present disclosure may be in terms of the included angle between radially outer chamfer surface 20 and cutting face 24 wherein, in accordance with the present disclosure, an included angle δ between radially outer chamfer surface 20 and cutting face 24 is greater than about 135°.

Arcuate surface 22, which may (as shown in FIG. 4), but need not necessarily, comprise a radius of curvature, desirably extends to respective contact points $C_1$ and $C_2$ with radially inner chamfer surface 20' and cutting face 24. While an exact tangential relationship may not be required, it is desirable that radially inner chamfer surface 20' and cutting face 24 respectively lie as tangentially as possible to the curve of arcuate surface 22 at respective contact points $C_1$ and $C_2$. It is further desirable that at least one of the radially inner chamfer surface 20' and cutting face 24 contact arcuate surface 22 tangentially. Thus, as particularly well depicted in cross-section in FIG. 4, radially inner chamfer surface 20' and cutting face 24 are substantially linear, while interposed surface 22 is arcuate and (by way of example) comprises a radius of curvature R (FIG. 3) to which radially inner chamfer surface 20' and cutting face 24 are substantially tangent at respective contact points $C_1$ and $C_2$. It should be noted that arcuate surface 22 is shown as shaded in FIG. 4 and with indistinct respective boundaries with radially inner chamfer surface 20' and cutting face 24 as, in practice, a precisely tangential contact between arcuate surface 22 and each of the flanking surfaces 20' and 24 will not exhibit any distinct boundary and a substantially tangential contact will in many instances result in an equally indistinct boundary.

The arcuate surface interposed between the cutting face and chamfer depicted in FIGS. 1, 2 and 4 is believed to exhibit the same resistance to impact-induced destruction as the aforementioned large radius approach, apparently reducing the diamond table edge stress concentration below some threshold level, while the sharp, angular transition between the chamfer and side surface of the diamond table provides an efficient cutting action.

Figure 5:
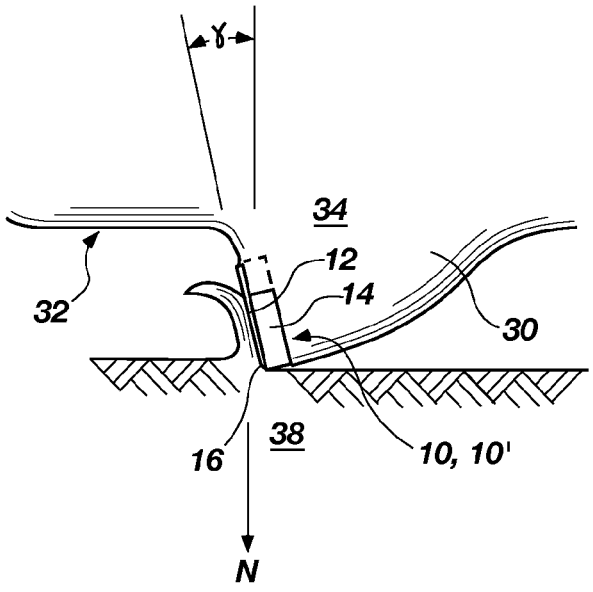
FIG. 5 is a side elevation of a PDC cutting element according to an embodiment of the present disclosure mounted on the face of a drill bit and in the process of cutting a formation.

FIG. 5 depicts a PDC cutting element 10, 10' according to the present disclosure mounted on protrusion 30 of bit face 32 of a rotary drag bit 34. Drag bit 34 is disposed in a borehole so that periphery 16 of the diamond table 12 of PDC cutting element 10, 10' is engaging formation 38 as bit 34 is rotated and weight is applied to the drill string to which bit 34 is affixed. It will be seen that normal forces N are oriented substantially parallel to the bit axis, and that the backraked PDC cutting element 10, 10' is subjected to the normal forces N at an acute angle thereto. In the illustration of FIG. 4, PDC cutting element 10, 10' is oriented at a backrake angle γ of 15° which, if PDC cutting element 10, 10' were of conventional, sharp-edged design, would be applied to the "corner" between the front and side of the diamond table and result in an extraordinarily high and destructive force concentration due to the minimal bearing area afforded by the point or line contact of the diamond table edge. However, PDC cutting element 10 as deployed on the bit of FIG. 5 may include a chamfer angle α of (for example) 15° to 20° with respect to side surface 28, substantially the same as, or slightly more than, the backrake angle γ of the cutting element. With such an arrangement, arcuate surface 22 bears and distributes a significant portion of the loading on PDC cutting element attributable to normal forces N and reduces stresses of formation cuttings that are pushed up on cutting face 24 during drilling. Moreover, sharp angular transition 26 between chamfer surface 20 and side surface 28 of diamond table 12 provides an aggressive, efficient cutting edge for removal of formation material. Stated another way, the loading per unit area is markedly decreased from the point or line contact of cutters with conventional 90° cutting edges due to the presence of arcuate surface 22, a particular advantage when drilling harder formations, without sacrificing drilling efficiency. Further, chamfer surface 20 effectively increases the surface of the diamond table 12 "seen" by the formation and the Normal forces N, which are applied perpendicularly thereto, while sharp, angular transition 26 provides a desirably aggressive cutting edge.

A more sophisticated approach to coordinating cutter backrake and chamfer angle is also possible by utilizing "effective" backrake, which takes into account the radial position of the cutting element on the drill bit and the design rate or design range of rate of penetration to factor in the actual distance traveled by the cutter per foot of advance of the drill bit and thereby arrive at the true or effective backrake angle of a cutting element in operation. Such an exercise is relatively easy with the computational power available in present day computers, but may in fact not be necessary so long as the chamfer utilized in a bit is matched to the apparent backrake angle of a stationary bit where stud-type cutters are employed. However, where cutter pockets are cast in a matrix-type bit, such individual backrake computations and grinding of matching chamfer angles on each cutter may be employed as part of the normal manufacturing process.

Fabrication of PDC cutting elements (including TSPs) in accordance with the present invention may be easily effected through use of a diamond abrasive or electro-discharge grinding wheel, or a combination thereof, and an appropriate fixture on which to mount the cutting element and, in the case of circular or partially round elements, to rotate them past the grinding wheel.

While the disclosure has been described in terms of a substantially planar diamond table, it should be recognized that the term "substantially planar" contemplates and includes convex, concave and otherwise nonlinear diamond tables which nonetheless comprise a two-dimensional diamond layer having a lateral dimension greater than a depth thereof, which can present a cutting edge proximate a peripheral edge. In addition, the disclosure is applicable to diamond tables of other than PDC structure, such as diamond and diamond-like carbon films, as well as other superabrasive materials such as cubic boron nitride and silicon nitride.

Moreover, it must be understood that the present disclosure is of equal benefit to straight or linear cutting edges as well as arcuate edges such as are illustrated and described herein. This, while the illustrated embodiments include annular chamfers and an annular arcuate surface interposed therebetween, the disclosure is not so limited. Further, it is contemplated that only a portion of the periphery of a diamond table, for example one half or even one third of the periphery, may be configured in accordance with the present disclosure.

Finally, it should be recognized and acknowledged that the arcuate surface as well as the sharp, angular transition will be worn off of the diamond table as the bit progresses in the formation and a substantially linear "wear flat" forms on the cutting element. However, the above-described features of the present disclosure serve to enhance protection of the new, unused diamond table against impact destruction while promoting cutting action until the diamond table has worn substantially from cutting the formation, after which point it has been demonstrated that the tendency of the diamond table to chip and spall has been markedly reduced.

In addition, while the present disclosure has been described in the context of use on a rotary drag bit, the term "drill bit" is intended to encompass not only full face bits but also core bits as well as other rotary drilling structures, including without limitation eccentric bits, bicenter bits, reaming apparatus (including without limitation so-called "reamer wings"), rock or tri-cone bits, and so-called "hybrid" bits (having both fixed cutting elements and rotating cutting structures) having one or more cutting elements according to the present disclosure fixedly mounted thereon. Accordingly, the use of the term drill bit herein and with specific reference to the claims contemplates and encompasses all of the foregoing, as well as additional types of rotary drilling structures.

While the cutting element, alone and in combination with a specific cooperative mounting orientation on a drill bit, has been disclosed herein in terms of certain embodiments, the invention is not so limited. It will be appreciated by those of ordinary skill in the art that many additions, deletions and modifications to the invention may be made without departing from the scope of the claims, including legal equivalents.

What is claimed is:

1. A drill bit for drilling a subterranean formation, comprising:

a bit body having a shank secured thereto for affixing the bit to a drill string; and a plurality of cutting elements secured to the bit body, at least one of the cutting elements having a longitudinal axis and comprising:

a substantially planar table of superabrasive material substantially facing a direction of intended bit rotation, a plane of the table extending perpendicular to the longitudinal axis of the cutting element, the plane of the table oriented at a backrake angle with respect to an axis of the drill bit, the superabrasive table having a cutting face, a side surface and a peripheral edge therebetween, the peripheral edge being defined at least in part by:

at least one chamfer between the side surface and the cutting face oriented at an acute angle to the side surface;

an arcuate surface extending directly between an outermost boundary of the cutting face and an innermost boundary of a chamfer of the at least one chamfer; and a sharp, angular transition between an outermost boundary of a chamfer of the at least one chamfer and the side surface;

wherein the acute angle of a radially outermost chamfer of the at least one chamfer with respect to the side surface of the table is approximately the same as or slightly more than the backrake angle of the plane of the table with respect to the axis of the drill bit; and wherein an included angle between the cutting face and the at least one chamfer is greater than about 135°.

2. The drill bit of claim 1, wherein the peripheral edge is nonlinear.

3. The drill bit of claim 1, wherein the cutting element includes a supporting substrate affixed to the table of superabrasive material.

4. The drill bit of claim 1, wherein the superabrasive material comprises a polycrystalline diamond compact.

5. The drill bit of claim 1, wherein the arcuate surface comprises, in cross-section, a radius of curvature.

6. The drill bit of claim 1, wherein at least one of an innermost boundary of the chamfer of the at least one chamfer and the outermost boundary of the cutting face contacts the arcuate surface substantially tangentially.

7. The drill bit of claim 1, wherein the at least one chamfer comprises a single chamfer between the cutting face and the side surface.

8. The drill bit of claim 1, wherein the at least one chamfer comprises a radially outer chamfer adjacent the side surface, and a radially inner chamfer adjacent the arcuate surface, an outermost boundary of the radially inner chamfer coinciding with an innermost boundary of the radially outer chamfer.

9. The drill bit of claim 8, wherein the radially inner chamfer is oriented at an acute angle to the side surface greater than an acute angle of the radially outer chamfer to the side surface.

10. A drill bit for drilling a subterranean formation, comprising:

a bit body having a shank secured thereto for affixing the bit to a drill string; and a plurality of cutting elements secured to the bit body, at least one of the cutting elements having a longitudinal axis and comprising:

a substantially planar table of superabrasive material substantially facing a direction of intended bit rotation, a plane of the table extending perpendicular to the longitudinal axis of the cutting element, the plane of the table oriented at a backrake angle with respect to an axis of the drill bit, the superabrasive table having a cutting face, a side surface and a peripheral edge therebetween, the peripheral edge being defined at least in part by:

a chamfer extending directly from the side surface toward the cutting face and oriented at an acute angle to the side surface;

an arcuate surface extending directly between an outermost boundary of the cutting face to an innermost boundary of a chamfer adjacent the cutting face; and a sharp, angular transition between an outermost boundary of the chamfer of the at least one chamfer and the side surface;

wherein the acute angle of a radially outermost chamfer of the at least one chamfer with respect to the side surface of the table is approximately the same as or slightly more than the backrake angle of the plane of the table with respect to the axis of the drill bit; and wherein the side surface is substantially parallel to a longitudinal axis of the cutting element and the acute angle is between about 15° and about 70°.

11. A rotary drilling structure for removing material from a subterranean formation, the rotary drilling structure comprising:

a body having structure secured thereto for affixing the rotary drilling structure to a drill string; and a plurality of cutting elements carried by the body, at least one of the cutting elements having a longitudinal axis and comprising:

a substantially planar table of superabrasive material substantially facing a direction of intended rotation of the rotary drilling structure, a plane of the table oriented at a backrake angle with respect to an axis of the rotary drilling structure, the superabrasive table having a cutting face, a side surface and a peripheral edge therebetween, the peripheral edge being defined at least in part by:

at least one chamfer between the side surface and the cutting face oriented at an acute angle to the side surface;

an arcuate surface extending directly between an outermost boundary of the cutting face and an innermost boundary of a chamfer of the at least one chamfer; and a sharp, angular transition between an outermost boundary of a chamfer of the at least one chamfer and the side surface;

wherein the acute angle of an outermost chamfer of the at least one chamfer with respect to the side surface of the table is approximately the same as or slightly more than the backrake angle of the plane of the table with respect to the axis of the rotary drilling structure; and;

wherein an included angle between the cutting face and the at least one chamfer is greater than about 135°.

12. The rotary drilling structure of claim 11, wherein the peripheral edge is nonlinear.

13. The rotary drilling structure of claim 11, wherein the cutting element includes a supporting substrate affixed to the table of superabrasive material.

14. The rotary drilling structure of claim 11, wherein the superabrasive material comprises a polycrystalline diamond compact.

15. The rotary drilling structure of claim 11, wherein the arcuate surface comprises, in cross-section, a radius of curvature.

16. The rotary drilling structure of claim 11, wherein at least one of an innermost boundary of the chamfer of the at least one chamfer and the outermost boundary of the cutting face contacts the arcuate surface substantially tangentially.

17. The rotary drilling structure of claim 11, wherein the at least one chamfer extends directly from the side surface toward the cutting face, the side surface is substantially parallel to a longitudinal axis of the cutting element and the acute angle is between about 15° and about 70°.

18. The rotary drilling structure of claim 11, wherein the at least one chamfer comprises a single chamfer between the cutting face and the side surface.

19. The rotary drilling structure of claim 11, wherein the at least one chamfer comprises a radially outer chamfer adjacent the side surface, and a radially inner chamfer adjacent the arcuate surface, an outermost boundary of the radially inner chamfer coinciding with an innermost boundary of the radially outer chamfer.

20. The rotary drilling structure of claim 11, wherein the radially inner chamfer is oriented at an acute angle to the side surface greater than an acute angle of the radially outer chamfer to the side surface.

* * * * *